US009363613B2

(12) United States Patent
Bergner et al.

(10) Patent No.: US 9,363,613 B2
(45) Date of Patent: Jun. 7, 2016

(54) ENVIRONMENTALLY SEALED HEARING ASSISTANCE DEVICE

(75) Inventors: Thomas Blaise Bergner, Chaska, MN (US); Thomas Spaulding, Eden Prairie, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 721 days.

(21) Appl. No.: 13/569,969

(22) Filed: Aug. 8, 2012

(65) Prior Publication Data

US 2014/0044292 A1 Feb. 13, 2014

(51) Int. Cl.
*H04R 25/00* (2006.01)

(52) U.S. Cl.
CPC ..... *H04R 25/608* (2013.01); *H04R 25/60* (2013.01); *H04R 25/65* (2013.01); *H04R 25/658* (2013.01); *H04R 2225/025* (2013.01); *Y10T 29/49002* (2015.01)

(58) Field of Classification Search
CPC .... H04R 25/60; H04R 25/604; H04R 25/608; H04R 25/652; H04R 25/654; H04R 25/658; H04R 2225/025; H04R 25/65; H04R 2225/023; H04R 2460/11
USPC ..... 381/312, 322, 324, 328, 329, 380; 181/129, 130, 135; 264/222; 29/592.1; 600/25
See application file for complete search history.

(56) References Cited

U.S. PATENT DOCUMENTS 5,321,757 A * 6/1994 Woodfill, Jr. ..... 381/312
6,339,648 B1 1/2002 Mcintosh et al.
6,354,990 B1 * 3/2002 Juneau ..... H04R 25/658 600/25
7,403,629 B1 7/2008 Aceti et al.
2003/0070868 A1 4/2003 Kolpe et al.
2004/0252854 A1 12/2004 Juneau et al.
2007/0071265 A1 3/2007 Leedom et al.

FOREIGN PATENT DOCUMENTS

EP 1245369 A2 10/2002

OTHER PUBLICATIONS

"European Application Serial No. 13179142.8, Extended European Search Report mailed Oct. 11, 2013", 6 pgs.
"European Application Serial No. 13179142.8, Extended Search Report Response filed Jul. 30, 2014 to Extended Search Report mailed Oct. 11, 2013", 14 pgs.

* cited by examiner

*Primary Examiner* — Huyen D Le
(74) *Attorney, Agent, or Firm* — Schwegman Lundberg & Woessner, P.A.

(57) ABSTRACT

Disclosed herein, among other things, are methods and apparatus for providing an environmentally sealed hearing assistance device that is easy to manufacture. One aspect of the present subject matter includes a method of manufacturing a hearing assistance device. A hearing assistance device electrical component is placed into a mold and a liquid polymer resin is inserted into the mold. The polymer resin is cured into a solid state to encase the electrical component. In various embodiments, the hearing assistance device is assembled using the encased electrical component. The polymer resin is adapted to resist moisture ingress and to protect the electrical component from corrosion, shock and vibration, in various embodiments.

20 Claims, 2 Drawing Sheets

ENVIRONMENTALLY SEALED HEARING ASSISTANCE DEVICE

FIELD OF THE INVENTION

The present subject matter relates generally to hearing assistance devices, and in particular to an environmentally sealed hearing assistance device that is easy to manufacture.

BACKGROUND

One of the recurring problems with any body worn device having transducers is the accumulation of material that might block the proper operation of the transducer. Hearing assistance devices which are body worn and which have one or more transducers frequently encounter an accumulation of moisture, wax or other foreign material which can occlude apertures for the transducers and cause damage to the transducers eventually. One example of a hearing assistance device is a hearing aid. Hearing aids have apertures for reception of sound which can be blocked by moisture, wax or other material. Hearing aids may use protective screens, such as a wax guard, microphone cover, or other acoustic screens which are intended to reduce the amount of unwanted substances that can reach the transducer. However, occlusion and other effects of the buildup of wax, moisture and other materials continue to be an issue with such devices.

One method of preventing foreign material entry is to insert a trap-style device which is a small cup with mesh at the bottom. One problem with the current method is that the mesh allows small amounts of material through, and the cup will become filled and require the hearing aid user to replace it.

What is needed in the art is a way to provide enhanced protection against the ingress of wax, moisture or other materials for hearing assistance devices, and to protect hearing assistance device components from shock and vibration.

SUMMARY

Disclosed herein, among other things, are methods and apparatus for providing an environmentally sealed hearing assistance device that is easy to manufacture. One aspect of the present subject matter includes a method of manufacturing a hearing assistance device. A hearing assistance device electrical component is placed into a mold and a liquid polymer resin is inserted into the mold. The polymer resin is cured into a solid state to encase the electrical component. In various embodiments, the hearing assistance device is assembled using the encased electrical component.

Another aspect of the present subject matter includes hearing assistance device including at least one encased electrical component. In various embodiments the encased electrical component is formed by placing the electrical component into a mold, inserting a liquid polymer resin into the mold, and curing the polymer resin into a solid state to encase the electrical component. The polymer resin is adapted to resist moisture ingress and to protect the electrical component from corrosion, shock and vibration, in various embodiments.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

Figure 1:
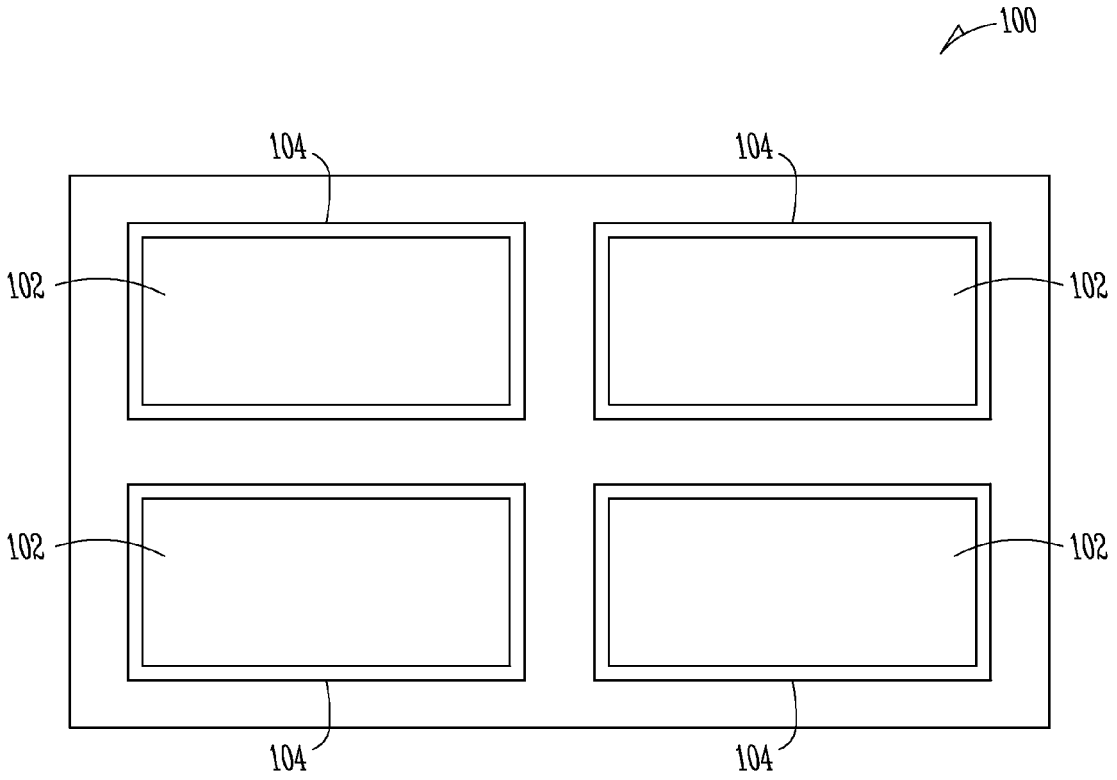
FIG. 1 is a block diagram showing an environmentally sealed hearing assistance device, according to one embodiment of the present subject matter.

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

Disclosed herein, among other things, are methods and apparatus for providing an environmentally sealed hearing assistance device that is easy to manufacture. The following examples will be provided for a hearing aid, which is only one type of hearing assistance device. It is understood however, that the disclosure is not limited to hearing aids and that the teachings provided herein can be applied to a variety of hearing assistance devices. The present subject matter is demonstrated for hearing assistance devices, including hearing aids, including but not limited to, behind-the-ear (BTE), in-the-ear (ITE), in-the-canal (ITC), receiver-in-canal (RIC) or receiver-in-the-ear (RITE), completely-in-the-canal (CIC) type hearing aids, and deep insertion devices having a transducer, such as a receiver or microphone, whether custom fitted, standard, open fitted or occlusive fitted. The present subject matter can be used with any device having a transducer configured to be placed in or proximal the ear canal of a wearer.

The present subject matter provides a hearing aid that is manufactured such that the electrical packaging inside the device is molded into a polymer part or parts. Benefits of the present subject matter include that it provides excellent resistance against moisture ingress into the hearing device which naturally corrodes or causes other damage to the electrical components. The encasement also protects the electrical packaging from shock and vibration that can cause damage from interior components bumping against one another. To encase the electrical components or electrical packaging, the electrical packaging/component is placed in a specialized fixture such as a lattice structure or a mold, in various embodiments. According to various embodiments, a polymer resin is then inserted into the fixture or mold encasing the components. After the polymer has cooled/cured a solid part is produced that can be used in the assembly of a hearing device, in various embodiments.

Currently, hearing devices are submitted to the elements while they are worn on or in the ear. Everyday chemicals, moisture and debris attack and damage the electrical packaging. Return rates are high in the hearing aid industry. The present subject matter directly addresses the high return rate by improving resistance to damaging foreign material ingress. Also, by eliminating the need for interior coatings, waxes, shock absorbing material and shims, manufacturing becomes simplified.

Previous solutions to foreign material mitigation include the use of elastomeric seals, nano-coating, glue, wax and reducing external case gaps. However, the previous solutions have many disadvantages. Elastomeric seals are large and bulky and can be difficult to accomplish especially when sealing against irregular surfaces or when incorporated in high gain devices. Nano-coatings are expensive and work for a limited period of time until they are rubbed off of the device. Glue and wax are inconsistent especially when applied by a manufacturer. Thus, the present subject matter is superior to previous solutions because it is very consistent and eliminates human variability in manufacturing. It also eliminates the need for systems such as glue, wax and coatings that complicate manufacturing and increase costs. Resulting from this process, hearing assistance devices will be more reliable and last longer, decreasing return rates and increasing patient acceptance.

The present subject matter uses polymer molding and incorporates the highly vulnerable electrical packaging of hearing assistance device components into the process. After the polymer molding, the final part is a fully encased and environmentally protected electronic package that can be used as a structural component in a hearing device. Thus, the present subject matter utilizes a new process to protect the electrical package of a hearing device from foreign material ingress, shock and vibration. In various embodiments, the present subject matter can be implemented into receiver cables, microphone modules, rechargeable battery modules, and other hearing assistance device components. Various types of polymer molding, including cool and low pressure molding, can be used in embodiments of the present subject matter.

FIG. 1 is a block diagram showing an environmentally sealed hearing assistance device, according to one embodiment of the present subject matter. The hearing assistance device 100 includes at least one electrical component 102 having an encasement 104. In various embodiments the encased electrical component 102 is formed by placing the electrical component into a mold, inserting a liquid polymer resin into the mold, and curing the polymer resin into a solid state to encase the electrical component. The polymer resin is adapted to resist moisture ingress and to protect the electrical component from corrosion, shock and vibration, in various embodiments. Various components of a hearing assistance device can be encased using the present subject matter. The electrical component includes electrical packaging, in an embodiment. In various embodiments, the electrical component includes a transducer, such as a microphone or a receiver. Other hearing assistance device components, such as the housing, hearing assistance electronics, processor, antenna, transceiver, transmitter, receiver, receiver cables, microphone modules, rechargeable battery modules, etc., can be encased in polymer resin using the present subject matter. Other components can be encased without departing from the scope of the present subject matter. In addition, other types of resins can be used without departing from the scope of the present subject matter. The examples provided herein are not intended in an exclusive or exhaustive sense.

Figure 2:
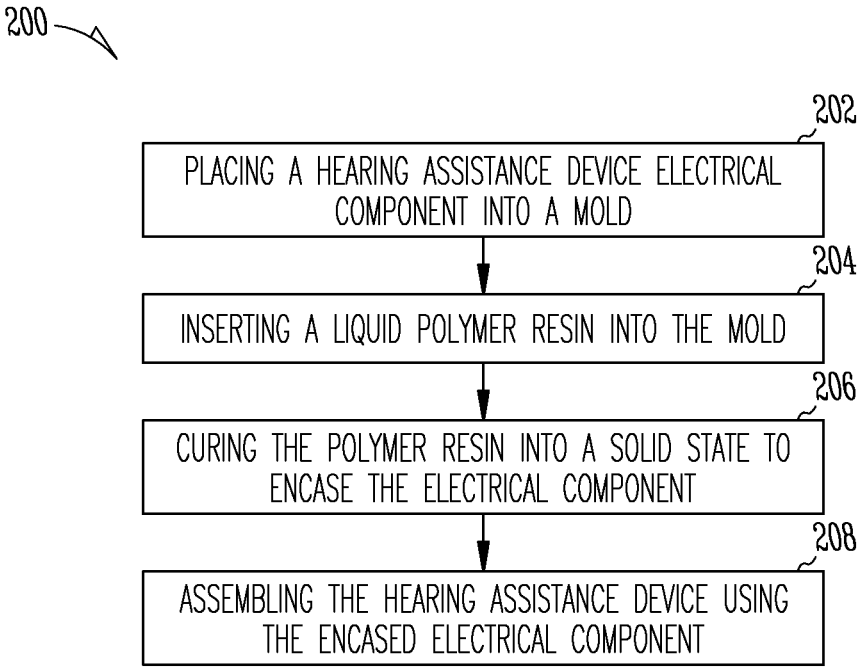
FIG. 2 is a flow diagram for a method of manufacturing a hearing assistance device, according to one embodiment of the present subject matter.

FIG. 2 is a flow diagram for a method 200 of manufacturing a hearing assistance device, according to one embodiment of the present subject matter. At 202, a hearing assistance device electrical component is placed into a mold and a liquid polymer resin is inserted into the mold, at 204. The polymer resin is cured into a solid state to encase the electrical component, at 206. In various embodiments, the hearing assistance device is assembled using the encased electrical component, at 208. In various embodiments placing a hearing assistance device electrical component into a mold includes placing the electrical component into a lattice structure. The method also includes assembling the hearing assistance device using multiple encased electrical components, in various embodiments.

The present subject matter prevents earwax, oils, moisture, and other foreign materials from reaching the hearing assistance electronics and causing damage. Therefore, this device will reduce repairs and warranty costs. Owners will not have to replace the devices as frequently as other designs.

The present subject matter is demonstrated for hearing assistance devices, including hearing aids, including but not limited to, behind-the-ear (BTE), in-the-ear (ITE), in-the-canal (ITC), receiver-in-canal (RIC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. The present subject matter can also be used in hearing assistance devices generally, such as cochlear implant type hearing devices and such as deep insertion devices having a transducer, such as a receiver or microphone, whether custom fitted, standard, open fitted or occlusive fitted. It is understood that other hearing assistance devices not expressly stated herein may be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A method of manufacturing a hearing assistance device, the method comprising:

placing a first hearing assistance device electrical component into a first mold, wherein the first electrical component includes a transducer;

inserting a first liquid polymer resin into the first mold;

curing the first polymer resin into a solid state to encase the first electrical component;

placing a second hearing assistance device electrical component into a second mold, the second mold not including the first mold;

inserting a second liquid polymer resin into the second mold;

curing the second polymer resin into a solid state to encase the second electrical component; and assembling the hearing assistance device using the first encased electrical component and the second encased electrical component.

2. The method of claim 1, wherein placing a hearing assistance device electrical component into a mold includes placing the electrical component into a lattice structure.

3. The method of claim 1, further comprising assembling the hearing assistance device using multiple encased electrical components.

4. The method of claim 1, wherein assembling the hearing assistance device includes assembling a hearing aid.

5. The method of claim 4, wherein assembling the hearing aid includes assembling a behind-the-ear (BTE) hearing aid.

6. The method of claim 4, wherein assembling the hearing aid includes assembling an in-the-ear (ITE) hearing aid.

7. The method of claim 4, wherein assembling the hearing aid includes assembling an in-the-canal (ITC) hearing aid.

8. The method of claim 4, wherein assembling the hearing aid includes assembling a receiver-in-canal (RIC) hearing aid.

9. The method of claim 4, wherein assembling the hearing aid includes assembling a completely-in-the-canal (CIC) hearing aid.

10. The method of claim 4, wherein assembling the hearing aid includes assembling a receiver-in-the-ear (RITE) hearing aid.

11. A hearing assistance device, comprising:

multiple individually encased electrical components, at least two of the individually encased electrical components formed by:

placing a first electrical component into a first mold;

inserting a liquid polymer resin into the first mold;

curing the polymer resin into a solid state to encase the first electrical component;

placing a second hearing assistance device electrical component into a second mold, the second mold not including the first mold;

inserting the liquid polymer resin into the second mold;

curing the liquid polymer resin into a solid state to encase the second electrical component; and assembling the hearing assistance device using the first encased electrical component and the second encased electrical component.

12. The device of claim 11, wherein the polymer resin is adapted to resist moisture ingress.

13. The device of claim 11, wherein the polymer resin is adapted to protect the electrical component from corrosion.

14. The device of claim 11, wherein the polymer resin is adapted to protect the electrical component from shock and vibration.

15. The device of claim 11, wherein the electrical component includes electrical packaging.

16. The device of claim 11, wherein the electrical component includes a transducer.

17. The device of claim 16, wherein the transducer comprises a microphone.

18. The device of claim 16, wherein the transducer comprises a receiver.

19. The device of claim 11, further comprising a housing, wherein at least a portion of the housing is adapted to be encased by:

placing the housing into a mold;

inserting a liquid polymer resin into the mold; and curing the polymer resin into a solid state to encase the housing.

20. The device of claim 11, wherein the mold includes a lattice structure.

* * * * *